US006132034A

United States Patent [19]

Miller

[11] Patent Number: 6,132,034

[45] Date of Patent: Oct. 17, 2000

[54] INK JET PRINT HEAD WITH FLOW CONTROL CONTOUR

[75] Inventor: Michael D. Miller, Shedd, Oreg.

[73] Assignee: Hewlett-Packard Company, Palo Alto, Calif.

[21] Appl. No.: 09/385,333

[22] Filed: Aug. 30, 1999

[51] Int. Cl.[7] ..... B41J 2/05; B41J 2/19

[52] U.S. Cl. ..... 347/65; 347/63; 347/92

[58] Field of Search ..... 347/63, 65, 85, 347/86, 87, 92, 67

[56] References Cited

U.S. PATENT DOCUMENTS

| | | | |
|---|---|---|---|
| 4,882,595 | 11/1989 | Trueba et al. | 347/92 |
| 4,929,963 | 5/1990 | Balazar | 347/89 |
| 4,931,811 | 6/1990 | Cowger et al. | 347/87 |
| 5,317,346 | 5/1994 | Garcia | 347/63 |
| 5,350,616 | 9/1994 | Pan et al. | 347/63 |
| 5,434,605 | 7/1995 | Osborne | 347/23 |
| 5,450,109 | 9/1995 | Hock | 347/67 |
| 5,463,413 | 10/1995 | Ho et al. | 347/65 |
| 5,635,966 | 6/1997 | Keefe et al. | 347/63 |
| 5,666,143 | 9/1997 | Burke et al. | 347/65 |
| 5,734,399 | 3/1998 | Weber et al. | 347/65 |
| 5,793,393 | 8/1998 | Coven | 347/65 |
| 5,815,185 | 9/1998 | Pietrzyk | 347/92 |

FOREIGN PATENT DOCUMENTS

| | | | |
|---|---|---|---|
| 403024964 | 2/1991 | Japan | 347/92 |
| 405338168 | 12/1993 | Japan | 347/92 |

*Primary Examiner*—John Barlow
*Assistant Examiner*—Juanita Stephens

[57] ABSTRACT

An ink jet print head with a substrate defining an ink aperture. A two-elevation structure in an ink manifold acts to urge coalescing bubbles away from ink energizing elements. A number of ink energizing elements are formed on one major surface of the substrate by a thin film layer or layers that only partially cover the one major surface of the substrate so as to leave part of the one major surface uncovered. A barrier layer is connected to the upper surface of the thin film layer leaving a second major surface that is the top of the thin film layer and peripherally encloses an ink manifold. The barrier encompasses the ink aperture. An orifice plate is connected to the barrier layer, spaced apart from the substrate's major surface, enclosing the ink manifold. The plate defines a number of orifices, each associated with a respective ink-energizing element.

26 Claims, 4 Drawing Sheets

INK JET PRINT HEAD WITH FLOW CONTROL CONTOUR

FIELD OF THE INVENTION

This invention relates to ink jet printers, and more particularly to ink jet printers with thermal ink jet print heads.

BACKGROUND OF THE INVENTION

Ink jet printers employ pens having print heads that reciprocate over a media sheet and expel droplets onto the sheet to generate a printed image or pattern. A typical print head includes a silicon chip substrate having a central ink hole that communicates with an ink filled chamber of the pen when the rear of the substrate is mounted against the pen. An array of firing resistors is positioned on the front of the substrate, within a chamber enclosed peripherally by a barrier layer surrounding the resistors and the ink aperture. An orifice plate connected to the barrier just above the front surface of the substrate encloses the chamber, and defines a firing orifice just above each resistor. Additional description of basic printhead structure may be found in "The Second-Generation thermal Inkjet Structure" by Ronald Askeland et al. in the Hewlett-Packard Journal, August 1988, pages 28–31; "Development of a High-Resolution Thermal Inkjet Printhead" by William A. Buskirk et al. in the Hewlett-Packard Journal, October 1988, pages 55–61; and "The Third-Generation HP Thermal Inkjet Printhead" by J. Stephen Aden et al. in the Hewlett-Packard Journal, February 1994, pages 41–45.

For a single color pen, the resistors are arranged in two parallel elongated arrays that each extend nearly the length of the substrate to provide a maximum array length for a given substrate chip size. The resistor arrays flank opposite sides of the ink aperture, which is typically, an elongated slot or elongated array of holes. To ensure structural integrity of the substrate, the ink aperture does not extend too close to the substrate edges, or as close to the edges as the endmost several firing resistors. Therefore, several resistors at each end of each array extend beyond the end of the ink supply aperture or slot.

While a reasonably effective configuration, it has been found that the end firing elements, that is, those that include the end resistors, are more susceptible to failure than are the multitude of firing elements that adjoin the length of the ink supply slot. It is believed that small air bubbles come primarily from two sources: those that arise from outgassing of ink components during normal operation, and those left behind after completion of pen assembly. These bubbles tend to aggregate and coalesce into larger bubbles in ends of the ink chamber. This occurs in the portions beyond the ends of the ink supply slots, and in the vicinity of the end resistors. Small bubbles present are normally tolerated because they can usually be "ejected," with only a single ink droplet being omitted from printed output; the firing element then continues properly following the momentary tolerable failure. However, it is believed that when the small tolerable bubbles are permitted to coalesce, they become large enough to permanently block one or more firing elements, preventing ink from reaching a firing, resistor.

SUMMARY OF THE INVENTION

The present invention overcomes the limitations of the prior art by providing an ink jet print head with at least two-levels formed in the ink manifold through which ink flows to ink-energizing elements from an ink reservoir.

First, a thin film layer in which ink energizing resistors are located, is placed on the substrate leaving a substantially planar region surrounding the ink aperture. On top of this planar thin film layer is placed a barrier layer, which peripherally encloses an ink manifold. The barrier also encompasses the ink aperture. An orifice plate is connected onto to the top of the barrier layer, spaced apart from the first and second planar surfaces formed by the thin film layer being displaced from around the ink aperture by some distance so as to form a shelf or two-step ink manifold or contoured ink flow control surface. The orifice plate or top plate, defines a number of small orifices, each associated with a respective ink-energizing element. The ink manifold is preferably an elongated chamber having opposed ends defined by end wall portions of the barrier layer. The barrier end wall portions each have an intermediate end wall portion protruding into the manifold.

A number of ink energizing elements is located on the first or "raised" surface of the substrate away from the ink aperture. A second surface of the substrate is formed between the first surface and around the ink aperture and formed to be at a different elevation or height with respect to the first surface. When the ink jet print head is viewed inverted from its normal operating orientation, this second surface is perceived as being "lowered" from the first surface. When in its operating position, the second surface, located between the first surface and surrounding the ink aperture, is seen as "raised" or "above" the level of the first surface.

The first surface 32 and the top plate 40 are separated by a nominal distance of $D_1$ whereas the second surface 35 and the first surface 32 are separated by a distance $D_2$, where $D_2.<D_1$.

As bubbles tend to form in the print head in the region between the first surface 32 and the top plate 40, they coalesce and naturally tend to seek a larger volume into which they can continue to grow. The two-step level formed in the ink manifold, which comprise the invention, tend to urge the bubbles toward the ink aperture from which they can flow back to the ink reservoir and disperse under the influence of gravity and buoyant forces. The coalescing bubbles will naturally tend to move to regions where the distance between the top plate 40 and the first surface 32 is small, i.e. $D_1$, to regions where the separation distance between the top plate 40 and the second surface 35 is greater, i.e. $D_2+D_1$.

The second, "higher" substrate surface $D_2$ is located between the first surface and the ink aperture in order to provide a region of the substrate having a greater volume that is close to the ink aperture and into which the increasing bubbles will migrate. As bubbles tend to form into this area, their migration tends to urge them closer to the ink aperture, which leads to the ink reservoir.

DETAILED DESCRIPTION OF THE PREFERRED EMBODIMENT

Figure 1:
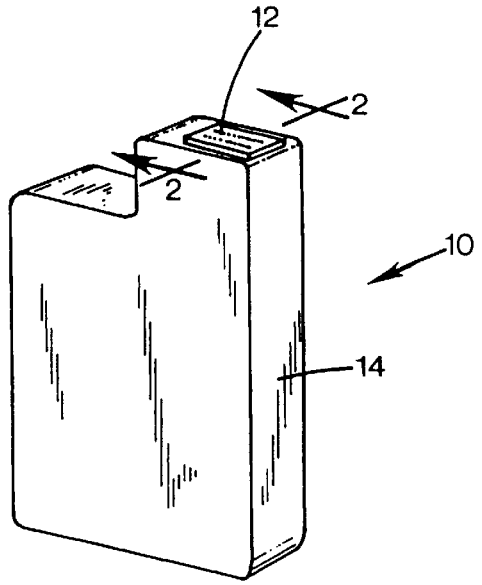
FIG. 1 is a perspective view of an ink jet pen according to a preferred embodiment of the invention.
Figure 7:
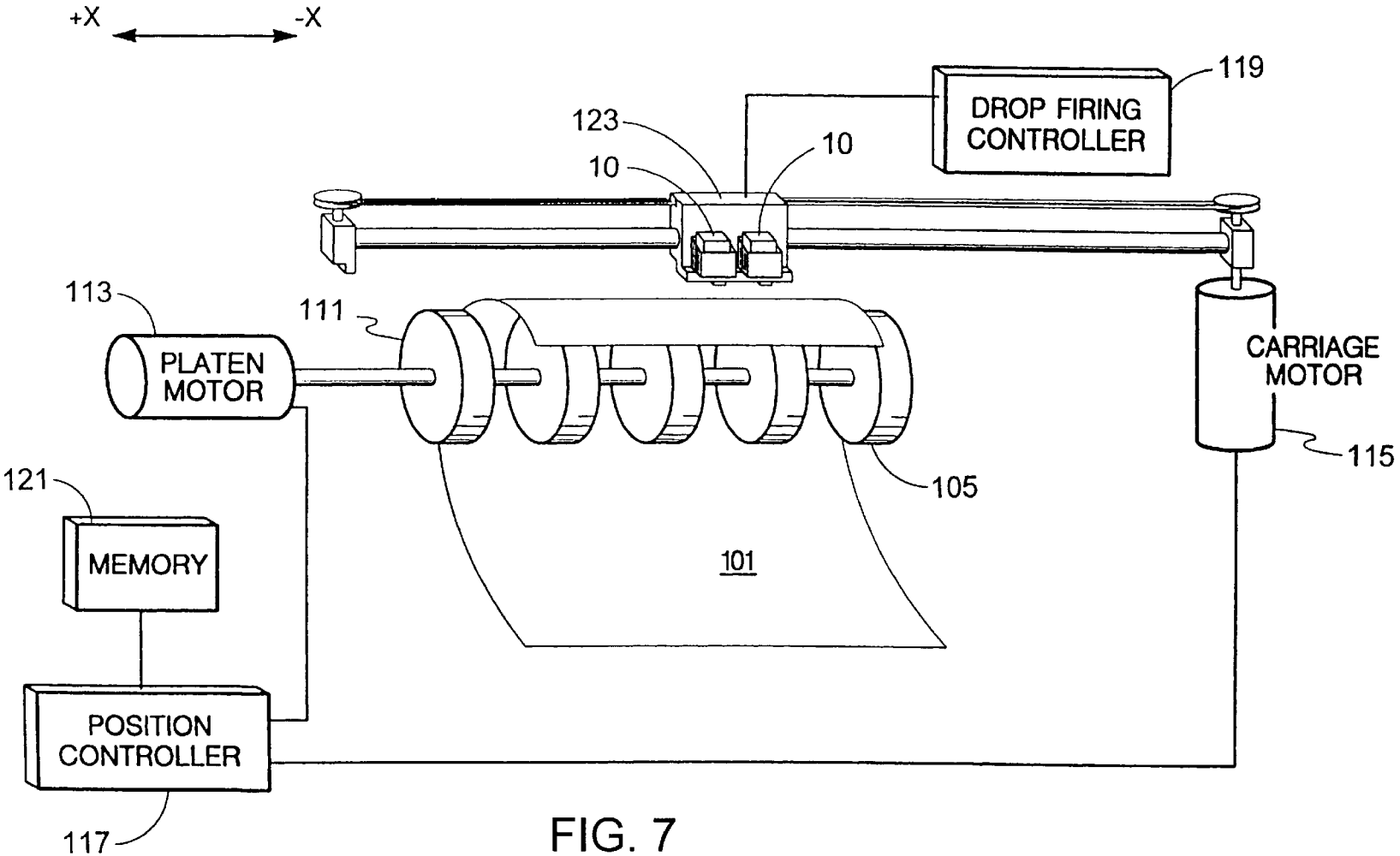
FIG. 7 is a printer mechanism for use with the print head.

FIG. 1 shows an ink jet pen 10 having a print head 12. (FIG. 7 shows two pens 10 as part of a print head carriage 123 used to print ink onto a paper as part of a printer.) The pen has a pen body 14 defining a chamber or reservoir 24 containing a supply of ink, which is supplied to the print head. An electrical interconnect (not shown) provides connection between a printer in which the pen is installed and the print head, so that the print head may control printing by the print head.

Figure 2:
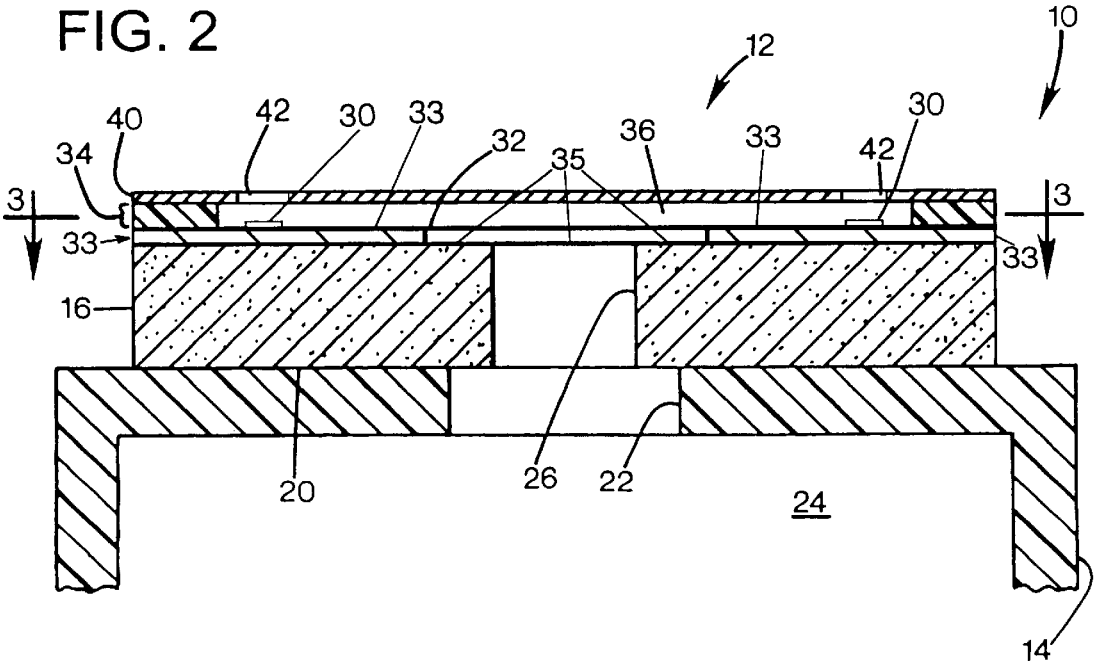
FIG. 2 is an enlarged sectional view of a print head taken along line 2—2 of FIG. 1.

FIG. 2 shows the print head 12 in cross section. The print head includes a silicon substrate 16 having a rear surface 20 mounted to the pen body 14. An ink outlet 22 in the pen body 14 opens into the ink chamber 24. The substrate defines an ink channel or ink aperture 26 registered with the ink outlet 22. A number of firing resistors 30 are located on a first or upper surface 32 of the substrate 16 arranged in rows (not shown in FIG. 2) on opposite sides of the ink channel 26. Not readily shown in FIG. 2 are various thin film layers 33 of material that are deposited atop the first or upper substrate 32 surface and in which the firing resistors 30 are formed. (The use of thin film layers 33 in an ink jet print head is disclosed in U.S. Pat. No. 5,635,968 to Bhaskar et al. For a "Thermal Inkjet Printhead with Offset Heater Resistors, the teachings of which are incorporated herein by reference.) The thin film layers of material 33 are used to selectively deliver electrical energy to the firing resistors 30, which in turn heat up to deliver thermal energy into localized firing regions by which ink is boiled to cause it to be ejected onto a printing surface.

Figure 3:
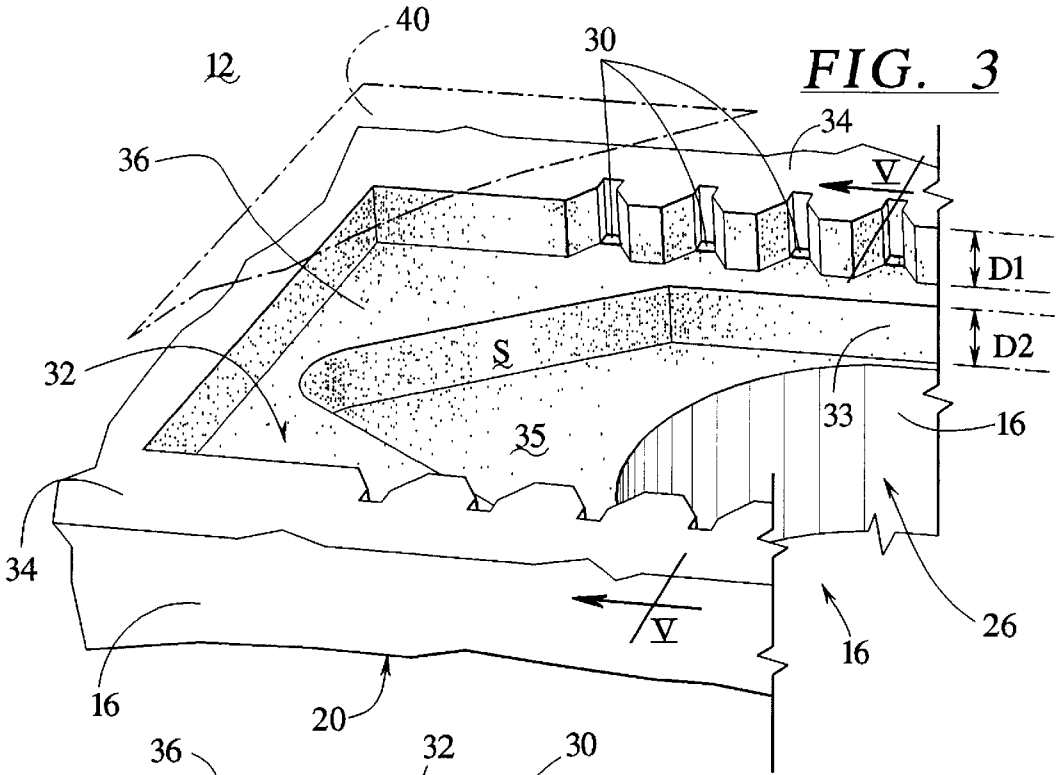
FIG. 3 is an enlarged perspective view of the print head of FIG. 2.

By re-routing and reforming the thin film layers 33 around the ink aperture 26 a second substantially planar surface 35 on the substrate 16 can be formed. This second surface 35 is at a different height or elevation with respect to the first surface 32. As shown in FIG. 3 the step or elevation difference between the first surface 32 and the second surface 35 defines another, substantially vertical surface, "S" between the first 32 and second surfaces 35, the presence of which can help to migrate coalescing bubbles back to the ink reservoir 24. Note that as the print head 12 is shown in the figure, first surface 32 is "elevated" with respect to the second surface 35 by the height of the surface S. When the print head 12 is in actual use, however, its orientation shown in the figures is reversed, i.e. inverted, and in that sense, the surface 35 is "elevated" above the surface 32.

A barrier layer 34 is attached to the upper surface 32 of the thin film layers 33, which are themselves atop the substrate 16, and covers the periphery of the substrate to laterally enclose an ink manifold chamber 36 and encompassing the resistors 30. A top or orifice plate 40 is attached atop the barrier layer 34 to enclose the manifold chamber 36. The orifice plate 40 defines arrays of ink orifices 42, each of which is registered with a respective firing resistor 30. In the preferred embodiment, the orifice plate 40 is approximately 25 microns thick, and the barrier layer 34 is approximately 14 microns thick, although alternatives may be used, and the drawings are not to scale.

FIG. 3 shows a perspective or isometric view of one end of the print head 12 the barrier layer 34 and substrate 16. The other end of the print head 12 is the same, with numerous intermediate features repeated between the ends. The resistors 30 are arranged in a first row 45 (shown in FIG. 4) and a second row 47 (shown in FIG. 4) with the resistors being evenly spaced apart in each row. The rows are axially offset by one-half of the resistor spacing to provide an evenly alternating arrangement that provides a higher resolution printed swath. The substrate ink aperture 26 is preferably an elongated oblong, with only a single end shown. However, alternate embodiments of the invention would include circular, elliptical or even rectangular cross-sectioned ink apertures 26.

The substantially planar surface 35, as well as the vertical surface S, both surround the ink aperture 26, whether the aperture is round, oblong or rectangular, so as to urge coalescing bubbles from each of the firing chambers to travel back to the ink reservoir 24. While the surface S is shown as being vertical, a linear or non-linear incline (e.g. parabolic) or curvature (elliptical or circular) forming the surface S, or any combination of inclined, vertical or curved sections of S would be equally effective in routing coalescing bubbles toward the ink aperture 26

Figure 5:
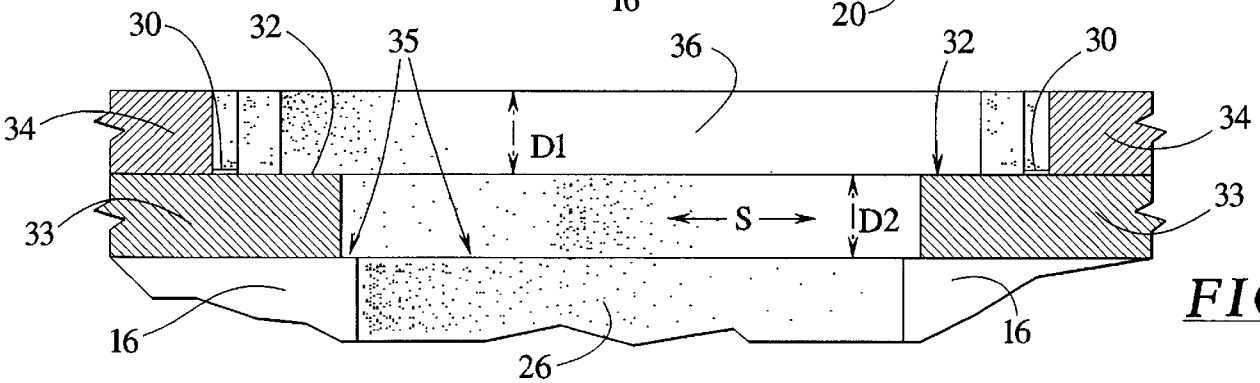
FIG. 5 is a sectional view of the structure shown in FIG. 3 through section lines 5—5.

It can be seen from FIGS. 3 and 5 that the thickness of the barrier layer 34, atop which lies the top, or orifice plate 40, substantially defines a distance $D_1$ between the orifice plate 40 and the first surface 32. Whereas the combined height of the barrier layer 34 and the re-formed thin film layer 33, which is re-formed to provide the second surface 35 between the aperture 26 and the first surface 32 defines distance $D_1+D_2$ between the top or orifice plate 40 and the second surface 35.

As shown, $D_1$ is measured between the top of the barrier layer 34 and the edge formed by the intersection of the barrier layer 34 and the top of thin film layer 33. $D_2$ on the other hand is measured between the top of the thin film layer 33 and the edge formed by the intersection of the ink aperture 26 and the second surface 35.

As bubbles around the firing elements 30 tend to coalesce, they will tend to do so in the areas permitting their increasing volume. In the print head 12 shown in FIG. 3, this area is the region where the "stepped-up" substrate or shelf of the second surface 35, that is made possible by re-forming the thin film layer 33, provides an increased volume into which the bubbles can expand. As the coalescing bubbles grow in size, they will tend to coalesce into regions where they can expand, i.e. into the region between the orifice plate 40 and the second surface 35.

Figure 4:
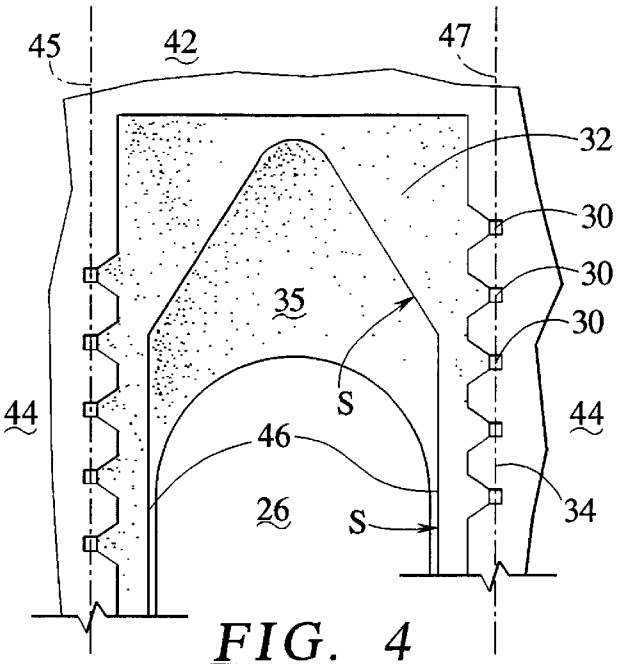
FIG. 4 is a top view of the structure shown in FIG. 3.

FIG. 4 shows a top view of the print head 12 structure shown in FIG. 3. From this view it can be seen that the second surface 35 extends away from the ink aperture 26 and is somewhat contoured toward the end 42 of the structure print head. Along the sides 44 of the ink aperture 26, the extent of the second surface 35 is shown to be substantially smaller, forming virtually a ridge 46 where the ink aperture 26 intersects the substantially planar second surface 35.

FIG. 5 shows a cut-away view of the structure shown in FIG. 3. While both the first surface 32 and the second surface 35 are shown as planar surfaces, those skilled in the art will of course appreciate that the surfaces 32 and 35 are characterized herein as substantially planar because the mathematical concept of a plane does not truly describe these surfaces 32 and 35. The surfaces 32 and 35 will almost always be formed with surface irregularities, which are not germane to the inventive concept disclosed herein.

In FIG. 5 the dimensions $D_1$ is the height or thickness of the barrier layer 34 and in the preferred embodiment is approximately 14 $\mu$m; $D_2$ is the height or thickness of the thin film layer 33 from which the step or surface S is formed and is typically 1–3 $\mu$m. The distance $D_2$ represents substantially the thickness of the several thin film layers 33 deposited atop each other and in the preferred embodiment $D_2$ as set forth above is typically on the order of 1–3 $\mu$m. Alternate embodiments of the invention would of course include substantial variations in these distances and would also include using more than a single step in the substrate.

Still other embodiments contemplated by the invention include fabricating the top plate 40 and barrier layer 34 together. In such an embodiment, the top plate 40 and the barrier layer 34 would not necessarily be separate structure but would be formed together as a single part thereafter assembled with, or onto the thin film layer 33. For purposes of claim construction, in alternate embodiments wherein a barrier layer (similar to that shown in the figures by reference numeral 34) and a top or orifice plate (such as that identified by reference numeral 40) are formed to be one and the same, is denominated herein as an orifice-barrier layer.

While the depiction shown in FIG. 3 is a vertical, wall-like surface S between the two planar surfaces 32 and 35, actual embodiments of the invention, by which the thin film layer 33 is formed might be constructed using vapor or chemical deposition techniques, or even abrasion or machining. In forming the two or more-level substrate, rarely will manufacturing techniques yield the sharply defined edges shown in FIGS. 3, 4 and 5. Indeed, alternate embodiments of the invention certainly contemplate various gradients between the different surfaces. The variety of surfaces by which the transition from the "lower" surface to the "higher" surface might be made certainly includes portions thereof that might be linear, elliptical, circular, stepped and so forth.

Figure 6:
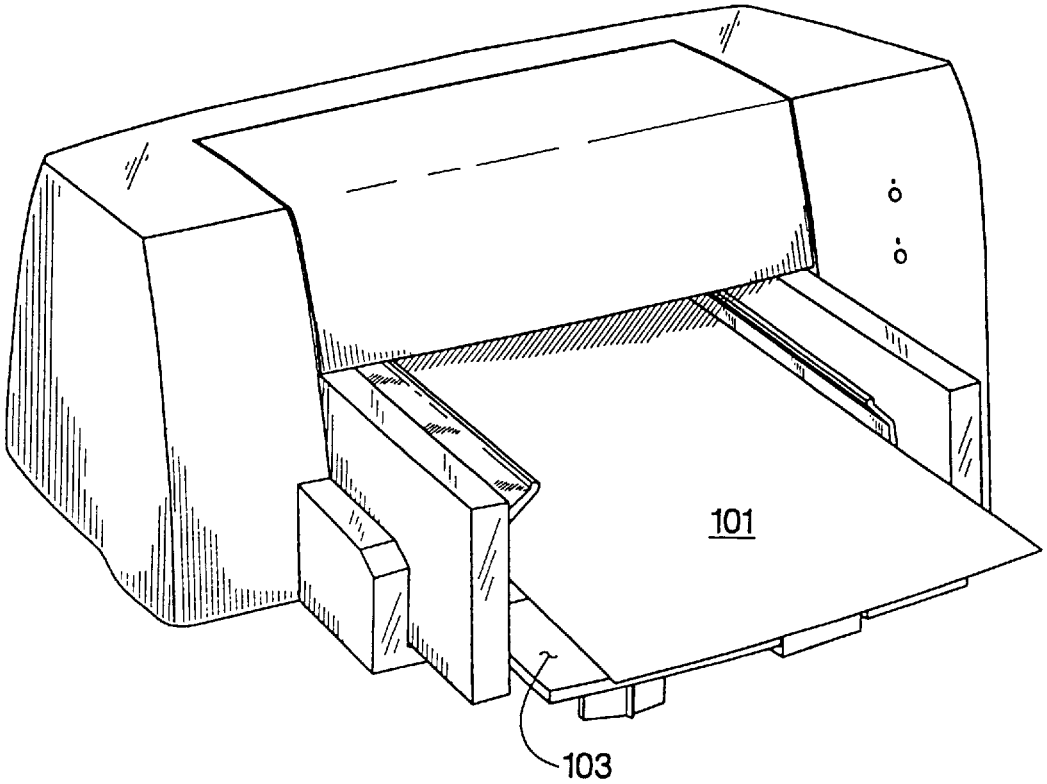
FIG. 6 is a printer for use with the print head.

An inkjet printer which may employ the present invention is illustrated in the isometric drawing of a typical inkjet printer shown in FIG. 6. Paper or other media 101, which may be printed upon, is stored in the input tray 103. Referring to the schematic representation of a printer of FIG. 7, a single sheet of media is advanced from a medium input 105 into a printer print area defined essentially by the print head of inkjet pens 10 by a medium advancing mechanism including a roller 111, a platen motor 113, and traction devices (not shown). In a typical printer, one or more inkjet pens 10 are incrementally drawn across the medium 101 on the platen by a carriage motor 115 in a direction perpendicular to the direction of entry of the medium. The platen motor 113 and the carriage motor 115 are typically under the control of a media and cartridge position controller 117. An example of such positioning and control apparatus may be found described in U.S. Pat. No. 5,070,410 "Apparatus and Method Using a Combined Read/Write Head for Processing and Storing Read Signals and for Providing Firing Signals to Thermally Actuated Ink Ejection Elements". Thus, the medium 101 is positioned in a location so that the pens 10 may eject droplets of ink to place dots on the medium as required by the data that is input to a drop firing controller 119 of the printer. These dots of ink are expelled from the selected orifices in a print head element of selected pens in a band parallel to the scan direction as the pens 10 are translated across the medium by the carriage motor 115. When the pens 10 reach the end of their travel at an end of a print swath on the medium 101, the medium is typically incrementally advanced by the media and cartridge position controller 117 and the platen motor 113. Once the pens have reached the end of their traverse in the X direction on a bar or other print cartridge support mechanism, they are either returned back along the support mechanism while continuing to print or returned without printing. The medium may be advanced by an incremental amount equivalent to the width of the ink ejecting portion of the print head or some fraction thereof related to the spacing between the nozzles. Control of the medium, positioning of the pen and selection of the correct ink ejectors of the print head for creation of an ink image or character is determined by the controller 117. The controller may be implemented in a conventional electronic hardware configuration and provided operating instructions from conventional memory 121. Once printing of the medium is complete, the medium is ejected into an output tray of the printer for user removal. Of course the printer's operation is enhanced by ink jet pens 10 that employ the print head 12 structures discussed above, including the multi-level surfaces within the ink manifold so as to better control bubble formation and coalescing bubble migration.

While the above is discussed in terms of preferred and alternative embodiments, the invention is not intended to be so limited. For instance, although shown as a single printhead for a single ink color, a print head may be provided with multiple portions like that shown on a single substrate. Each may have a single ink supply slot connected to its own pen ink chamber, and flanked by rows of nozzles dedicated to that color. In addition, the end wall protrusion may have any protruding shape that reduces the manifold volume along the midline at the end, or which serves to direct ink flow on a more direct path to end nozzles.

What is claimed is:

1. An ink jet print head comprising:

a substrate defining an ink aperture through which ink flows from a reservoir, said substrate further having first and second major surfaces, said second major surface substantially surrounding said ink aperture and said first major surface substantially disposed over and surrounding said second major surface such that a step is defined by an elevation between the first and second major surfaces;

a step between said first and second major surfaces, said step surface offset from and substantially surrounding said ink aperture;

a plurality of ink energizing elements substantially on the first major surface of the substrate;

a barrier layer connected to the first major surface thereby forming wall portions of said barrier layer, said barrier layer peripherally defining an ink manifold, and encompassing the ink aperture;

an orifice plate connected to the barrier layer, spaced apart from the substrate first major surface, enclosing the ink manifold, and defining a plurality of orifices, each associated with a respective ink energizing element.

2. The print head of claim 1 wherein said step surface has an elevation substantially equal to a height $D_2$.

3. The print head of claim 1 wherein said elevation between the first and second major surfaces is formed from a thin film layer deposited on said substrate.

4. The print head of claim 2 wherein said height $D_2$ is approximately 1–3 $\mu$m.

5. The print head of claim 1 wherein at least one of said first major surface and said second major surface are substantially planar.

6. The print head of claim 1 wherein at least part of said step surface is inclined at an angle with respect to at least one of said first and second major surfaces.

7. The print head of claim 1 wherein at least part of said step surface is elliptical.

8. The print head of claim 1 wherein said step surface is stepped.

9. The print head of claim 1 wherein said step surface is linear.

10. The print head of claim 1 wherein the ink energizing elements are arranged in a linear array.

11. The print head of claim 1 wherein the periphery of the ink manifold has opposed major edges, each defining an array of extending chambers, each chamber encompassing a respective ink energizing element.

12. The print head of claim 1 wherein said ink manifold is a substantially elongated chamber.

13. The print head of claim 1 wherein said orifice plate and said barrier layer are comprised of an orifice-barrier layer.

14. An ink jet print head comprising:

a substrate defining an elongated ink aperture having opposed ends and opposed sides through which ink flows from a reservoir, said substrate further having first and second major surfaces, said second major surface substantially surrounding said ink aperture and said first major surface substantially disposed over and surrounding said second major surface such that a step is defined by an elevation between the first and second major surfaces;

a step surface between said first and second major surfaces, said step surface offset from and substantially surrounding said ink aperture;

a plurality of ink energizing elements substantially on the first major surface of the substrate in two elongated rows on opposite sides of the ink aperture;

a barrier layer connected to the first major surface, and peripherally defining an elongated ink manifold encompassing the ink aperture;

the ink manifold being an elongated chamber having opposed ends defined by end wall portions of the barrier layer.

15. The print head of claim 14 wherein at least one of the ink energizing elements extends beyond the ends of the ink aperature.

16. The print head of claim 14 wherein said elevation is a thin film layer deposited between said second surface of the substrate and said barrier layer.

17. The print head of claim 14 including an orifice plate attached to the barrier layer to enclose the manifold, and defining a plurality orifices, each associated with a respective ink energizing element.

18. An ink jet printer comprising:

an inkjet print head comprising:

a substrate defining an ink aperture through which ink flows from a reservoir, said substrate further having first and second major surfaces, said second major surface substantially surrounding said ink aperture and said first major surface substantially disposed over and surrounding said second major surface such that a step is defined by an elevation between the first and second major surfaces;

a step surface between said first and second major surfaces, said step surface offset from and substantially surrounding said ink aperture;

a plurality of ink energizing elements substantially on the first major surface of the substrate;

a barrier layer connected to the major surface thereby forming wall portions of said barrier layer, said barrier layer peripherally defining an ink manifold, and encompassing the ink aperture;

an orifice plate connected to the barrier layer, spaced apart from the substrate second major surface, enclosing the ink manifold, and defining a plurality of orifices, each associated with a respective ink energizing element;

a print head carriage; and a print head position controller.

19. A method of manufacturing an ink jet print head in a substrate having a substantially planar top surface comprising the steps of:

defining an ink aperture portion through the substrate;

disposing a plurality of ink energizing elements on the top surface of the substrate in a thin film layer that is deposited on said top surface of the substrate, said thin film layer characterized in that is formed to establish a first planar region on said top surface of said substrate offset from and substantially surrounding said ink aperture portion, said thin film layer further having an upper surface that is at a different elevation with respect to the top surface of the substrate;

forming a barrier layer onto the upper surface of said thin film layer to peripherally define an ink manifold encompassing the ink aperture portion and the first planar region, said ink manifold having opposed ends defined by end wall portions of the barrier layer whereby ink energizing elements include end elements at each end, and the barrier end wall portions each include a protrusion extending between the end element of one row and a corresponding end element of another row.

20. A method in accordance with the method of claim 19 further comprising the steps of extending at least one ink energizing element beyond the ends of the ink manifold.

21. A method in accordance with the method of claim 19 further comprising the steps of attaching an orifice plate attached to the barrier layer to enclose the ink manifold, and defining a plurality orifices, each associated with a respective ink energizing element.

22. An ink jet print head comprising:

a substrate defining an ink aperture and having a first major surface;

a thin film layer deposited on a first region of said first major surface, offset from and surrounding said ink aperture, and forming a plurality of ink energizing elements on said thin film layer, a second region of said first major surface being left substantially uncovered by said thin film layer;

a barrier layer connected to a top surface of said thin film layer, peripherally defining an ink manifold, and encompassing the ink aperture;

an orifice plate connected to the barrier layer, spaced apart from the first major surface of said substrate, enclosing the ink manifold, and defining a plurality of orifices, each associated with a respective ink energizing element, the ink manifold being an elongated chamber having opposed ends defined by end wall portions of the barrier layer.

23. The print head of claim 22 wherein said orifice plate and said barrier layer are comprised of an orifice-barrier layer.

24. A printer cartridge comprising:

an ink reservoir;

a substrate defining an ink aperture through which ink flows from said ink reservoir, said substrate further having first and second major surfaces, said second major surface substantially surrounding said ink aperture and said first major surface substantially disposed over and surrounding said second major surface such that a step is defined by an elevation between the first and second major surfaces;

a step surface between said first and second major surfaces, said step surface offset from and substantially surrounding said ink aperture;

a plurality of ink energizing elements substantially on the first major surface of the substrate;

a barrier layer connected to the first major surface thereby forming wall portions of said barrier layer, said barrier layer peripherally defining an ink manifold, and encompassing the ink aperture;

an orifice plate connected to the barrier layer, spaced apart from the substrate first major surface, enclosing the ink manifold, and defining a plurality of orifices, each associated with a respective ink energizing element; and electrical contacts coupling at least one of said ink energizing elements to an electrical power source.

25. The print head of claim 24 wherein said ink manifold is a substantially elongated chamber.

26. The print head of claim 24 wherein said orifice plate and said barrier layer are comprised of an orifice-barrier layer.

* * * * *